United States Patent [19]

Merry et al.

[11] 4,002,393

[45] Jan. 11, 1977

[54] CONTACT MEANS FOR FLAT CONDUCTOR CABLE AND METHOD OF CONNECTING SAME

[75] Inventors: Roydon William Merry, Harrisburg; James Lee Sherman, Bethel Park, both of Pa.

[73] Assignee: AMP Incorporated, Harrisburg, Pa.

[22] Filed: Sept. 10, 1975

[21] Appl. No.: 612,160

Related U.S. Application Data

[60] Division of Ser. No. 529,767, Dec. 5, 1974, abandoned, which is a continuation of Ser. No. 333,579, Feb. 20, 1973, abandoned.

[52] U.S. Cl. ..... 339/97 C

[51] Int. Cl.[2] ..... H01R 11/20

[58] Field of Search ..... 339/17, 31–33, 339/176, 217, 219, 220, 242, 252, 256, 258, 276, 97–99

[56] References Cited

UNITED STATES PATENTS

| | | | |
|---|---|---|---|
| 3,395,381 | 7/1968 | Huffnagle | 339/97 C |
| 3,492,628 | 1/1970 | Matthews | 339/17 |
| 3,697,925 | 10/1972 | Henschen | 339/17 F |
| 3,713,072 | 1/1973 | Henschen et al. | 339/17 F |

*Primary Examiner*—Joseph H. McGlynn
*Attorney, Agent, or Firm*—William J. Keating; Donald W. Phillion

[57] ABSTRACT

A contact has a contact portion, a backing member, and a leg integrally connected together and stamped and formed from sheet metal. The contact is crimpable to a flat conductor cable having a conductive layer with first and second insulating layers disposed on the opposite sides thereof. The cable is disposed adjacent the contact with the first insulating layer toward the backing member so that a region of the backing member overlies the conductive layer, with the second insulating layer toward an extended end portion of the leg, and with a cross-sectional section of the cable adjacent a base portion of the leg. The leg is deformed to cause the cable to be pressed between the end portion and the region of the backing member and to cause the extended end portion to pierce the second insulating layer and make electrical contact with the conductive layer. Continued deformation of the leg causes the end portion and the region of the backing member to converge at an angle having an apex directed generally toward the cross-sectional section of the cable. When the contact is completely crimped to the cable, the extended end portion of the leg and the region of the backing member are disposed in an overlapping relationship with the cable retained therebetween such that any tendency toward relaxation by the contact which might otherwise be detrimental to the electrical contact of the extended end portion of the leg with the conductive layer of the cable is resisted by the overlapping relationship and any relaxation that might be allowed by the overlapping relationship would be in a direction to enhance the quality of the electrical contact.

4 Claims, 19 Drawing Figures

CONTACT MEANS FOR FLAT CONDUCTOR CABLE AND METHOD OF CONNECTING SAME

This is a division of application Ser. No. 529,767, filed Dec.5, 1974, by Roydon William Merry and James Lee Sherman for "Contact Means For Flat Conductor Cable And Method Of Connecting Same", now abandoned, which is in turn a continuation of application Ser. No. 333,579 filed Feb. 20, 1973, by Roydon William Merry and James Lee Sherman for "Contact Means For Flat Conductor Cable And Method Of Connecting Same", now abandoned.

BACKGROUND OF THE INVENTION

1. Field of the Invention

This invention relates to a contact means and more specifically to a contact means which is crimped to a flat conductor cable. The method of crimping the contact means to the cable is such that any tendency toward relaxation of the contact means after the crimping will not be detrimental to the electrical contact with the conductive layer which is produced by the crimping.

2. Description of the Prior Art

Flat conductor cable comprises a tape-like strip of suitable plastic in which there is embedded a layer of conductive material. Conductor cables of this type have been widely available for some years and have resulted in a wide variety of specialized types of connecting devices.

The prior art shows both crimp-type terminations for flat conductor cables and solder-type terminations. In many prior art devices, preparation of the cable by way of stripping of the insulation is necessary preparatory to the application of the terminal to the cable. In other devices, the connector is intended to pierce and be crimped through the insulation to make contact with the conductive layer within the cable. When utilizing the crimp-type termination with either stripped or pierced insulation, it has generally been recognized that the relaxation of the contact means after crimping might be detrimental to the electrical connection. This relaxation of the contact means has generally detracted from the overall desirability of the crimp-type terminations which are generally less expensive and easier to provide than the solder-type terminations.

One prior art contact means disclosed in U.S. Pat. No. 3,395,381 fully recognizes this relaxation problem. Specifically, this prior art contact means has a channel or U-shaped cross-section comprising a web and upstanding sidewalls extending from the web. Lances are struck inwardly from the plane of the web such that in the final crimped connection, the conductor is pinched between the lances and the extended ends of the sidewalls which have been curled inwardly to pierce the insulating layer and make electrical contact with the conductive layer. The relaxation of the sidewalls is generally compensated by the spring action of the lances to minimize the likelihood that the relaxation will be detrimental to the electrical connection. However, the cross-sectional area of reliable electrical contact is limited to those points where the ends of the sidewalls and the lances intersect. Although some electrical contact with the conductive layer is indicated at the base of the sidewalls, there is nothing disclosed to indicate or ensure its reliability. Therefore, the amount of current to be reliably passed from the conductive layer to the contact means is limited by the cross-sectional area at these points of intersection.

SUBJECT OF THE INVENTION

It is, therefore, an object of the present invention to provide a contact means crimpable to a flat conductor cable with or without a layer of insulating material.

It is another object to provide a contact means of the type described which will resist a tendency to relax after crimping which would be detrimental to the electrical contact with the conductive layer of the cable.

It is a further object to provide a contact means of the type described which will enhance the electrical connection with the conductive layer if the contact means relaxes after crimping.

It is still a further object to provide a contact means of the type described which will provide sufficient area of reliable electrical contact with the conductive layer for high current uses.

It is yet another object to provide a contact means of the type described which can be stamped and formed from sheet metal to provide low cost, convenient electrical termination.

The disclosed contact means is capable of being electrically crimped to a flat electrical conductor cable including an electrically conductive layer and first and second insulating layers disposed on opposite sides of the conductive layer. To accomplish the aforementioned and other objects, the disclosed contact means includes an electrically conductive metallic contact portion and a backing member supporting the contact portion and having at least a region capable of overlying the conductive layer of the cable and contacting the first insulating layer of the cable. A metallic leg of the contact means is electrically connected to the contact portion and has a base portion which is extendable by a cross-sectional section of the cable and an extended end portion which is disposable outwardly of the second insulating layer of the cable when the region of the backing member overlies the conductive layer and contacts the first insulating layer of the cable. When the conductor cable is so disposed adjacent the contact means, the leg of the contact means is deformed to cause the extended end portion to penetrate the second insulating layer to make electrical contact with the electrically conductive layer and to press the cable between the end portion and the region of the backing member. The extended end portion and the region of the backing member converge at an angle having an apex directed generally toward the cross-sectional section of the cable. After the contact means is completely crimped to the cable, the extended end portion of the leg and the region of the backing member are disposed in an overlapping relationship with the cable retained therebetween such that any tendency toward relaxation by the contact means after the crimping which might otherwise be detrimental to the electrical contact of the extended end portion of the leg with the conductive layer of the cable is resisted by the overlapping relationship and any relaxation that might be allowed by the overlapping relationship would be in a direction to enhance the quality of the electrical contact. During crimping, the cable is elastically deformed within an area bound by the leg and the backing member such that the cable applies expansive forces against the extended end portion in a direction away from the base portion of the leg to bias the extended end portion toward the region of the backing member such that the biasing compliments the tendency toward relaxation of the contact means to further enhance the quality of the electrical contact of the extended end portion with the conductive layer. When the cross-sectional section of the cable includes an exposed portion of the conductive layer, the exposed portion makes electrical contact with the base portion of the leg which contact with the base portion will be enhanced by the elastic deformation of the cable.

DETAILED DESCRIPTION OF THE EMBODIMENTS

Figure 1:
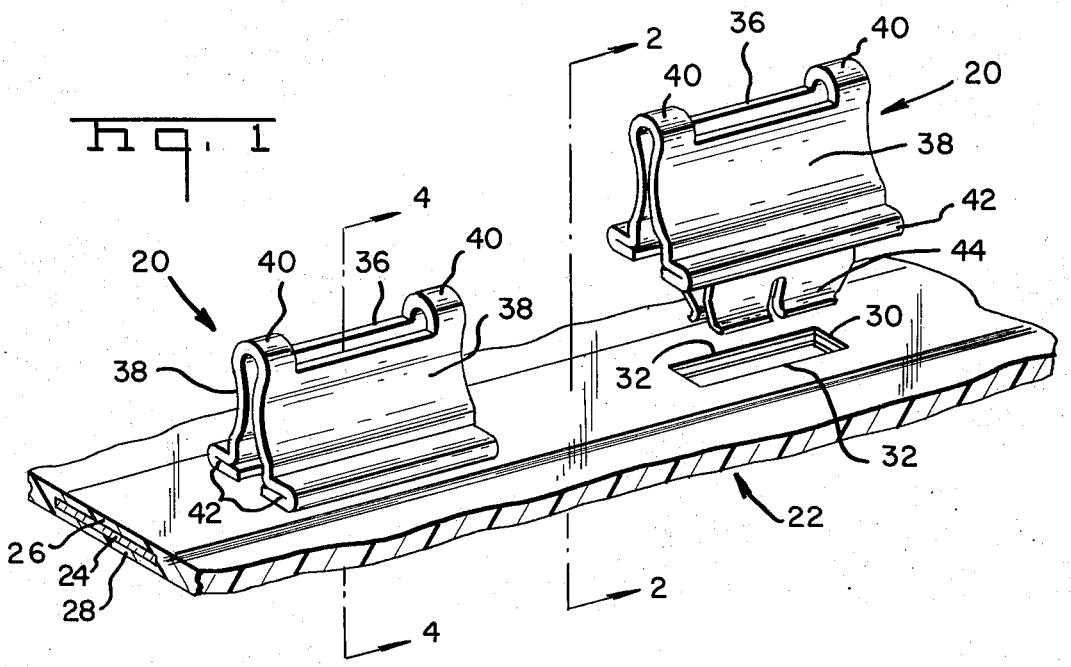
FIG. 1 is a perspective view of a preferred embodiment of the invention as crimped to a conductor cable and as provided before crimping.

Referring to the drawings, FIGS. 1 through 5 show several views of a preferred contact means 20 which includes various features of the invention. In FIG. 1, the contact means 20 shown at the left is crimped to a flat conductor cable 22 while the contact means 20 at the right is shown prior to its being crimped to the cable 22. The cable 22 includes a conductive layer 24 having a first insulating layer 26 and a second insulating layer 28 disposed on opposite sides thereof. The layers 26 and 28 are of a suitable plastic film such as Mylar (polyethylene terephthalate) to provide a tough and durable protective coating for the conductive layer 24. In preparation for a preferred application of the contact means 20 to the cable 22, an opening 30 is provided in the cable 22 in the area of the conductive layer 24 to define two opposing cross-sectional sections 32 of the cable, each of which include an exposed area 34 of the conductive layer 24.

The contact means 20 is stamped and formed from sheet metal and includes a contact portion 36. The contact portion 36 is U-shaped and inverted to have sidewalls 38 depending from a pair of spaced-apart cross members 40. The sidewalls 38 are curved inwardly so that the contact portion 36 maintains mechanical and electrical contact with a tab (not shown) which is extended through the opening 30 and between the deflected sidewalls 38.

Figure 2:
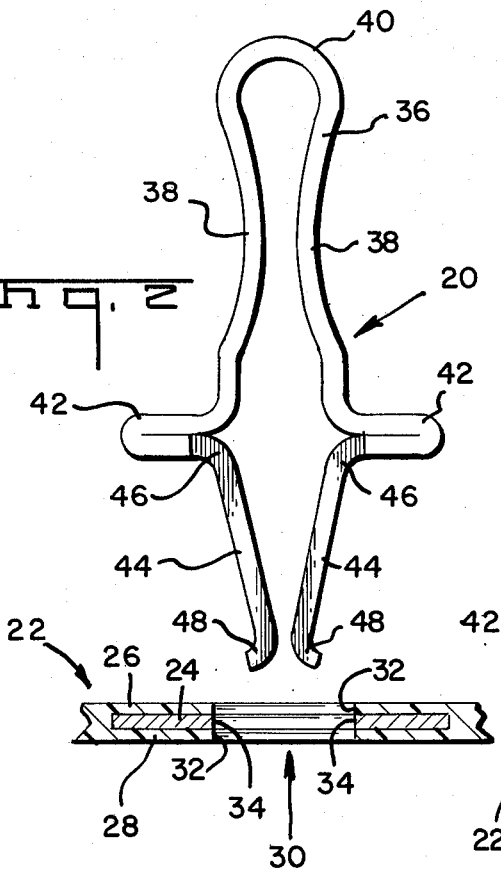
FIG. 2 is a cross-sectional view of the preferred embodiment as seen along line 2—2 of FIG. 1.
Figure 3:
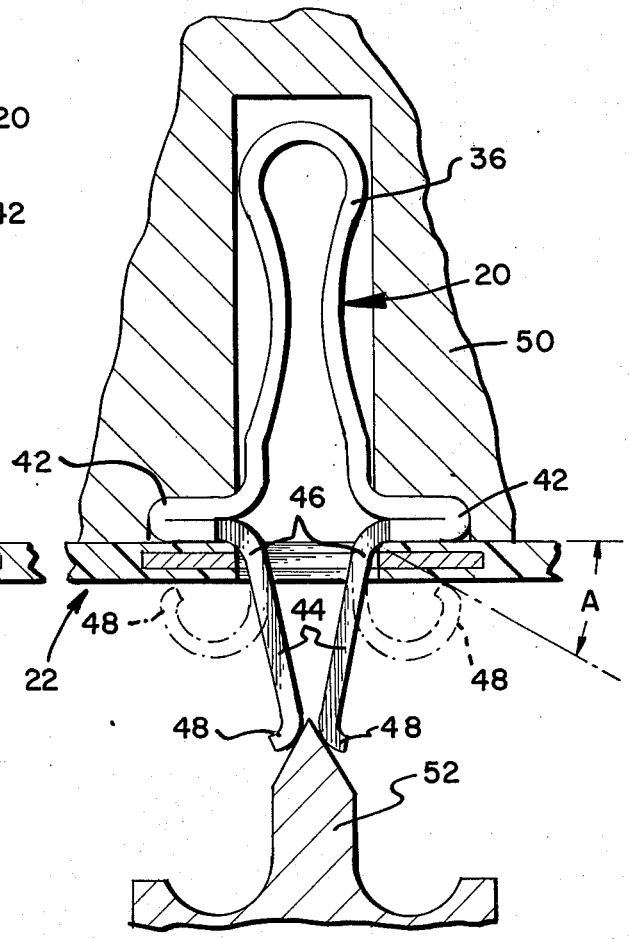
FIG. 3 is a cross-sectional view of the preferred embodiment shown in FIG. 2 including a die configuration to be utilized in the crimping.

To facilitate electrical connection of the contact means 20 to the cable 22, a backing member 42 extends outwardly from the base of each sidewall 38. As best seen in FIGS. 2 and 3, the backing member 42 is disposed adjacent the cable 22 to make contact with the first insulating layer 26 and to overlie the conductive layer 24. Depending from each backing member 42 is a deformable leg 44 which extends through the opening 30. Each leg 44 is positioned with a base portion 46 adjacent its corresponding cross-sectional section 32 of the cable 22 and an extended end portion 48 extending outwardly of the second insulating layer 28.

As seen in FIG. 3, a pair of crimping dies 50 and 52 are utilized to crimp the contact means 20 to the cable 22. The die 50 is stationary and supports the contact portion 36 and the backing members 42 against the first insulating layer 26 of the cable 22. The die 52 is aligned with the die 50 to deform each of the legs 44 by curling them outwardly and then back toward their respective backing members 42. It can be seen that this die configuration would normally cause the extended end portion 48 to converge toward the backing member 42 at a right angle as shown in the prior art. However, in the preferred contact means 20, the extended end portions 48 are preformed to curl outwardly from the longitudinal extent of the leg 44. Therefore, as shown in FIG. 3, the extended end portions 48 converge toward their respective backing members 42 at an angle A having an apex directed generally toward the cross-sectional section 32 of the cable 22.

Figure 4:
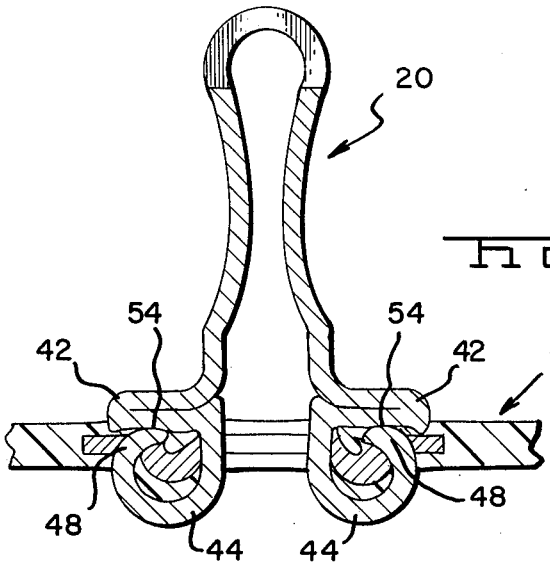
FIG. 4 is a cross-sectional view of the preferred embodiment as seen along line 4—4 of FIG. 1.

Complete deformation of the leg 44, as shown in FIG. 4, causes the extended end portion 48 and the backing member 42 to be disposed in an overlapping relationship as indicated at 54, as the extended end portion 48 is deformed under the resistance of the backing member 42 to be disposed generally parallel with the backing member 42.

Figure 5:
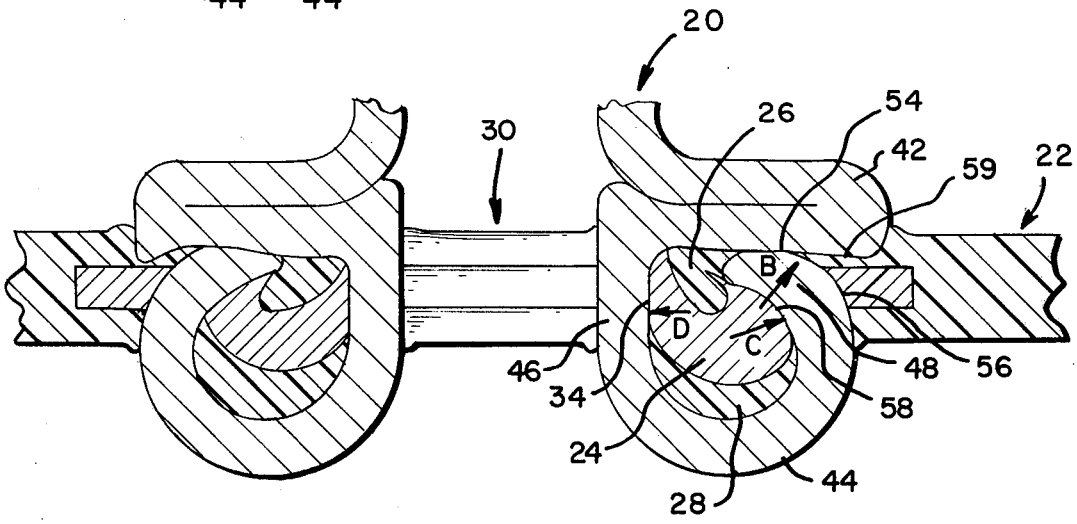
FIG. 5 is an enlarged view of the crimping area of the embodiment as shown in FIG. 4.

Since both crimped portions of the contact means 20 are the same, only one will be discussed while referring to the detailed view shown in FIG. 5. It can be seen that in this preferred crimp the extended end portion 48 has pierced the second insulating layer 28 and penetrated the conductive 24 to provide a substantial area of electrical contact at 56 and 58. The natural tendency toward relaxation of the leg 44 after crimping will be in a direction of the arrow B as the leg 44 attempts to uncurl. The overlapping relationship of the extended end portion 48 and the backing member 42 causes the extended end portion 48 to be pressed toward and restricted by a surface 59 of the backing member 42 to maintain electrical contact with the conductive layer 24 at 56 and 58.

An additional feature of the contact means 20 is provided by the final deformation of the extended end portion 48. The extended end portion 48 initially makes contact with the conductive layer 24 and converges toward the backing member 42 at a location more remote from the base portion 46 of the leg 44 than its location after complete crimping. The final deformation of the extended end portion 48 causes it to move toward the base portion 46 as it slides along the surface 59 to establish the overlapping relationship with the backing member 42. The movement of the extended end portion 48 toward the base portion 46 of the leg 44 elastically deforms the cable 22 as it is confined between the leg 44 and the backing member 42. The natural relaxation of the deformed cable 22 applies an expansive force to the leg 44 indicated generally at arrow C. However, it can be seen that movement of the extended end portion 48 is again resisted by the backing member 42 as with the tendency toward relaxation of the leg 44 and there is no detrimental effect on the electrical or mechanical connection. Further, since the expansive forces are also in a direction as indicated by the arrow D, the overall electrical connection between the contact member 20 and the conductive layer 24 is enhanced. The electrical contact between the exposed area 34 of the conductive layer 24 and the base portion 46 of the leg 44 and between the layer 24 and the extended end portion 48 at 58 are both maintained by the expansive force of the resiliently deformed cable 22.

Figure 6:
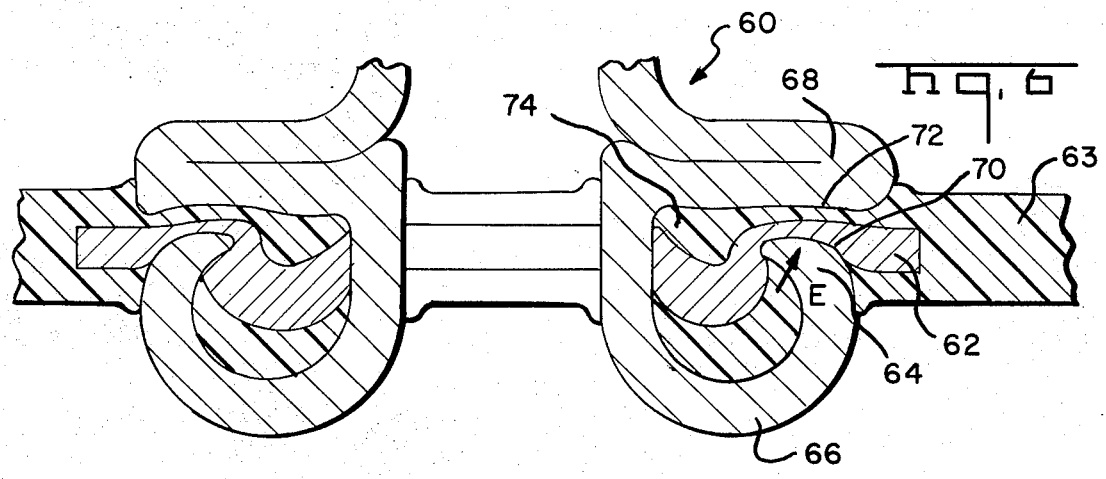
FIG. 6 is a view like that of FIG. 5 showing an alternative crimping configuration.

A different result is obtained in the contact 60 shown in FIG. 6. By altering the structure of a conductive layer 62 of a cable 63 or an extended end portion 64 of a leg 66, the extended end portion 64 does not penetrate the conductive layer 62. For example, the extended end portion may be weakened so that it is not sufficiently rigid and will therefore bend under the resistance of a thicker conductive layer. However, the overlapping relationship of the extended end portion 64 and a backing member 68 still resists relaxation of the leg 66. Further, since the relaxation is in a direction indicated by the arrow E, the electrical contact with the conductive layer 62 at 70 is enhanced as the conductive layer 62 is pressed between the extended end portion 64 and the backing member 68.

It can be further seen that by making a surface 72 of the backing member abrasive, such as by the introduction of an electrically conductive grit to the surface 72, the sliding movement of the cable 63 along the surface 72 will cause a first insulating layer 74 to be worn away to allow the backing member 68 to make electrical contact with the conductive layer 62, which contact will also be enhanced by the force E.

Recognizing the essential features of the contact means 20 and 60 of the extended end portions and the backing members converging at an angle which results in their overlapping relationship, it can be seen that a number of contact means and methods may be employed to obtain similarly enhanced electrical and mechanical connections with a conductor cable.

Figure 7:
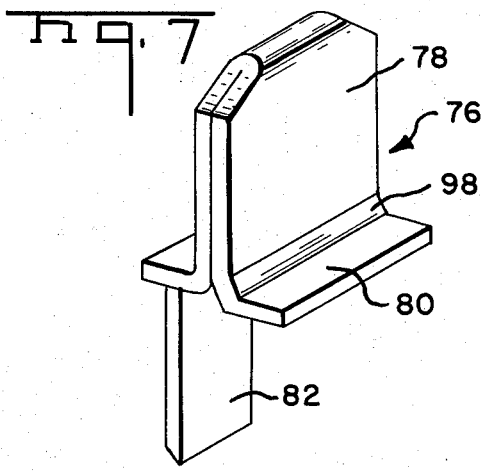
FIG. 7 is a perspective view of another embodiment including various features of the invention.
Figure 8:
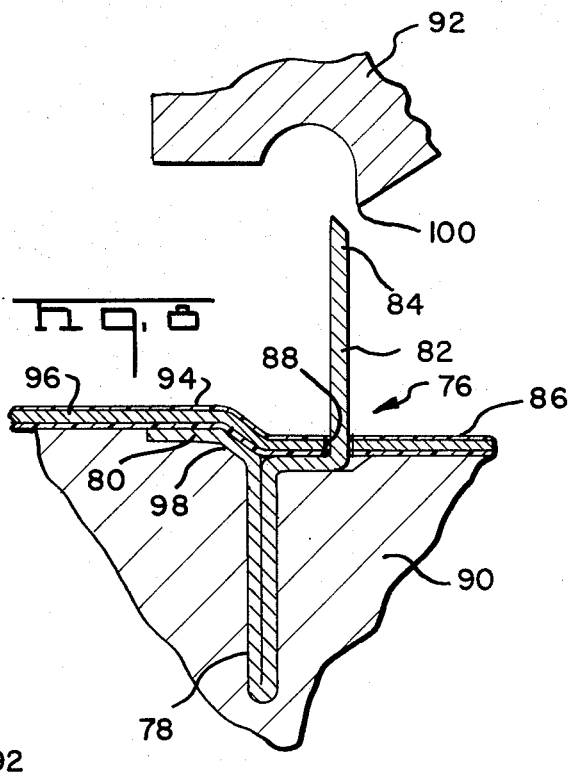
FIG. 8 is a sectional side view of the embodiment of FIG. 7 and an associated die configuration to accomplish the desired crimping.
Figure 9:
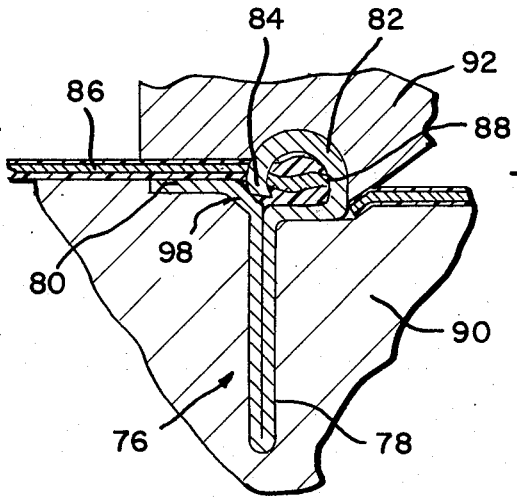
FIG. 9 is the embodiment shown in FIG. 8 after crimping.
Figure 10:
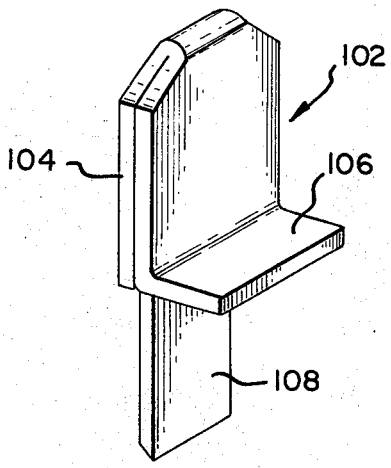
FIG. 10 is a perspective view of still another embodiment including various features of the invention.

Another contact means 76 is shown in FIGS. 7 through 9. The contact means 76 includes a contact portion 78, a backing member 80 and a leg 82. In the contact means 76, the leg 82 has a straight extended end portion 84 which is tapered to facilitate initial piercing of a conductor cable 86 to position the leg 82 by a cross-sectional section 88 of the cable 86 formed by the piercing of the cable. The die configuration 90 and 92 initially curls the leg 82 to turn the extended end portion 84 180° so that it penetrates an insulating layer 94 and makes electrical contact with a conductive layer 96 of the cable 86. In order to have the extended end portion 84 and the backing member 80 converge at an angle and overlap to resist the relaxation of the leg 82 after crimping, a region 98 of the backing member 80 is preformed at an angle against which the extended end portion 84 is again deformed to move toward the cross-sectional section 88. Although an extension 100 in the die 92 is included to provide backing for the leg 82 to ensure the movement of the extended end portion 84 toward the cross-sectional section 88, this could be accomplished by a separate die means. The various features that enhance the electrical and mechanical connection of the contacts described hereinabove are included in the contact means 76.

Figure 11:
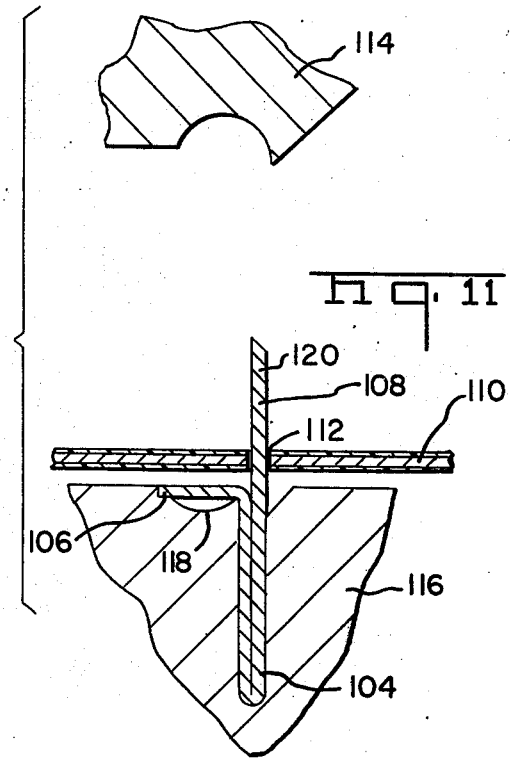
FIG. 11 is a sectional side view of the embodiment of FIG. 10 and another associated die configuration to accomplish the desired crimping.
Figure 12:
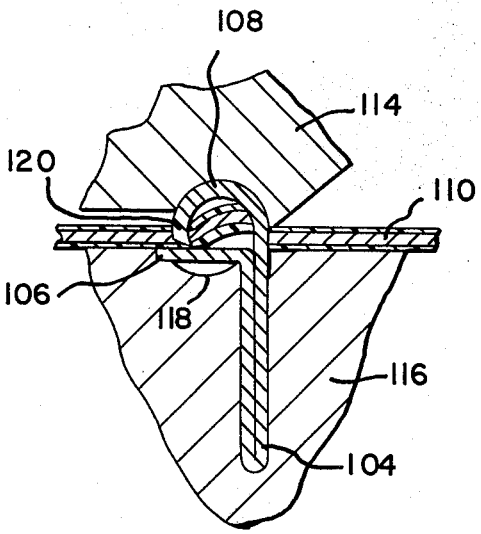
FIG. 12 is the embodiment shown in FIG. 11 prior to complete deformation.
Figure 13:
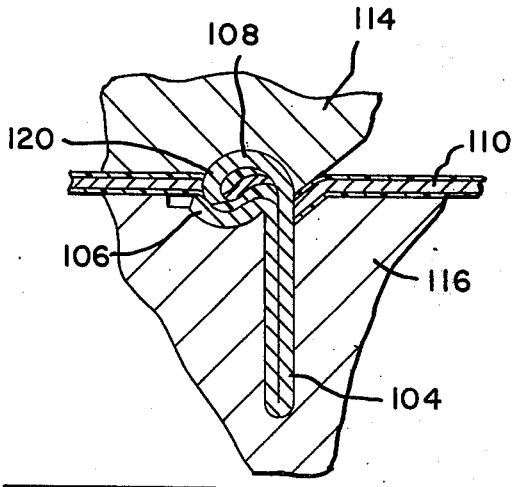
FIG. 13 is the embodiment shown in FIG. 11 after crimping.

Another contact means 102 is shown in FIGS. 10 through 13 and includes a contact portion 104, a backing member 106 and a leg 108. Like the contact means 76, the contact means 102 includes a straight leg 108 which can pierce a cable 110 or be extended through a hole 112 therein. An upper die 114, shown in FIG. 11, is like the die 92 shown in FIG. 8. However, the lower die 116 includes a concave portion 118 behind the initially straight backing member 106. The die 114 initially directs an extended end portion 120 of the leg 108 to approach the backing member 106 at a right angle as shown in FIG. 12. Further deformation, as shown in FIG. 13, causes the extended end portion 120 to press the backing member 106 into the concave 118 of the lower die 116. This deformation of the backing member 106 provides the angle of convergence which allows the backing member 106 to then deform the extended end portion 120 to produce the overlapping relationship and movement of the extended end portion 120 toward the cross-sectional section of the cable 110 at the opening 112 in the same manner as described hereinabove.

Figure 14:
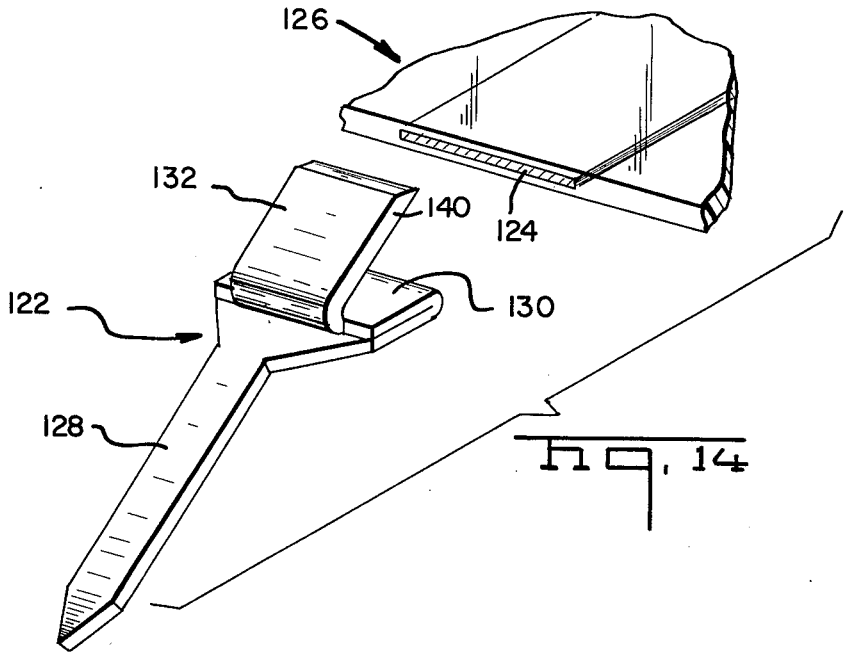
FIG. 14 is a perspective view of yet another embodiment of the invention and the conductor cable.
Figure 15:
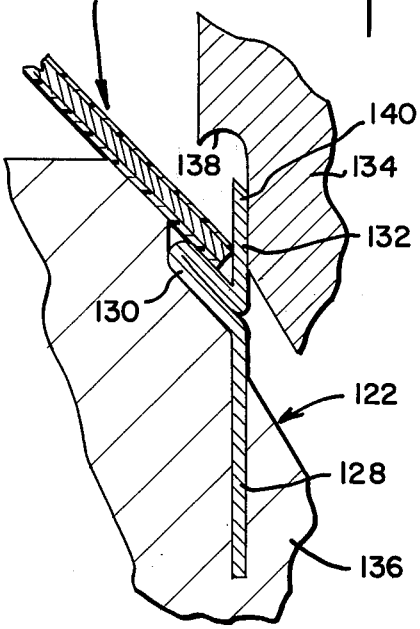
FIG. 15 is a sectional side view of the embodiment shown in FIG. 14 and still another associated die configuration to accomplish the desired crimping.
Figure 16:
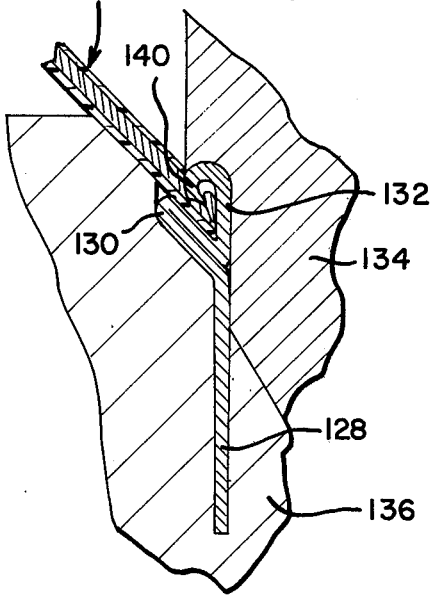
FIG. 16 is a view of the embodiment as shown in FIG. 15 after crimping.

Still another contact means 122 is shown in FIG. 14 which can be crimped to a conductor cable 126 at a cross-sectional end 124. The contact means 122 includes a contact portion 128, a backing member 130 and a leg 132. However, as seen in FIG. 15, the contact means 122 and the cable 126 are disposed between a pair of mating dies 134 and 136 in an orientation different from those described hereinabove. In the contact means 122, the upper die 134 approaches the backing member 130 and the cable 126 at an angle. As a result, the curve of the die face 138 of the upper die 134 is sufficient to initially direct an extended end portion 140 of the leg 132 at an angle toward the backing member 130. The final deformation of the leg 132 again causes the extended end portion 140 to be deformed by the backing member 130 to assume an overlapping relationship with the backing member 130 as it moves towards the cross-sectional edge 124 of the cable 126.

Figure 17:
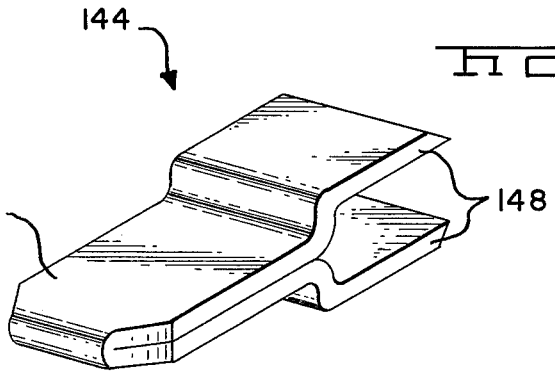
FIG. 17 is a perspective view of one more embodiment including various features of the invention.
Figure 18:
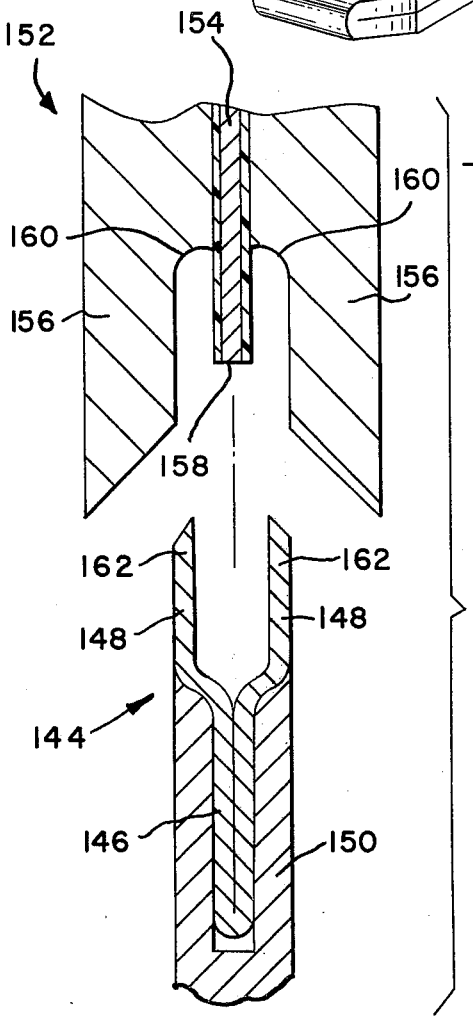
FIG. 18 is a sectional side view of the embodiment of FIG. 17 and yet another associated die configuration and cble orientation to accomplish the desired crimping.
Figure 19:
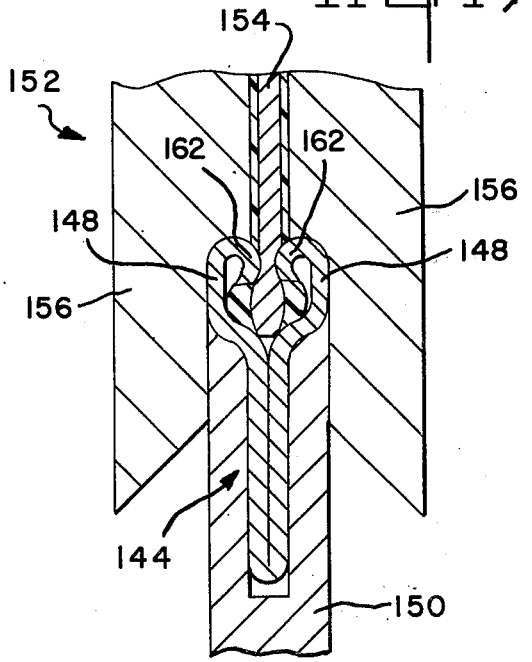
FIG. 19 is a view of the embodiment shown in FIG. 18 after crimping.

A final preferred embodiment of the invention is shown at 144 in FIGS. 17 through 19. The contact means 144 includes a contact portion 146 with a pair of bifurcated, spaced-apart legs 148 extending therefrom. As seen in FIG. 18, the contact means 144 is positioned within a support die 150 with the legs 148 extending upwardly therefrom toward a forming die 152. A cable 154 is supported between the halves 156 of the die 152 so that a predetermined length of the cable extends toward the contact means 144 and a cross-sectional edge 158 of the cable 154 will be directed between the legs 148.

It can be seen in FIG. 19 that the forming surface 160 of each half 156 of the die 152 will direct an extended end portion 162 of its corresponding leg 148 toward the cable 154 so that the extended end portion 162 pierces the insulation of the cable 154 and makes electrical contact with its conductive layer. Further, since the extended end portions 162 will converge at an angle having an apex directed generally toward the cross-sectional edge 158, the continued deformation of the legs 148 causes each extended end portion 162 to serve as a backing member for the other extended end portion 162 in a similar manner as in the embodiments described hereinabove. Therefore, when the contact means 144 is finally crimped to the cable 154, the cable 154 is again retained by relaxation forces between the extended end portions 162 as it had been previously retained in the embodiments described hereinabove, and, because of the predetermined length of the cable 154 which extends from the die halves 156, it is again elastically deformed within the region bound by the legs 148. With the design of the contact means 144, an enhanced electrical and mechanical connection is provided between both extended end portions 162 and the conductive layer of the cable 154. It should be noted that although, in this embodiment, the cable is initially supported between the die halves 156, it would be possible to first position the cable between the legs 148 and then to bring the halves 156 in sliding contact with the cable toward the die 150 to deform the legs 148.

From the embodiments described hereinabove, various features of the invention should not be apparent. For example, the overlapping relationship that enhances the electrical and mechanical connection with an insulated cable will also be applicable if a stripped cable is utilized. In addition, the entire width of the extended end portion or the base portion of the leg provide electrical contact area with the conductive layer and simply increasing the width will increase the current carrying capacity of the contact means. Further, in some embodiments, the backing member is not deformed nor intended to make an electrical connection with the conductive layer and could, therefore, be made of a non-conductive material. It should also be apparent, from the wide variety of contact portions specifically shown, that any number of types or styles of contact portions might be utilized depending upon the particular application in which the contact means is to be used.

It is thought that the invention and many of its attendant advantages will be understood from the foregoing description and it will be apparent that various changes may be made in the form, construction and arrangement of the various embodiments of the contact means described without departing from the spirit and scope of the invention or sacrificing all of its material advantages, the forms hereinbefore described being merely preferred embodiments thereof.

What is claimed is:

1. An assembly comprising contact means and a flat electrically conductive cable comprising a flat conductive layer, with said contact means being crimped to make electrical contact with said conductive layer in said flat electrically conductive cable, and in which said contact means comprises:

a contact portion;

a first backing member connected to and supporting said contact portion and having a first surface portion positioned upon a first section of a first side of said conductive layer and generally parallel to said first section; and a first conductive leg integrally connected at one end to said first backing member with its other end extending through said conductive layer of said cable;

said other end of said first conductive leg being crimped in a curled configuration back upon itself and penetrating through said conductive layer and then extending towards the junction of said first conductive leg and said first backing member in a path adjacent to and generally parallel with the first surface portion of said first backing member, and exerting a force upon said first surface portion of said first backing member due to the tendency of the first conductive leg to relax.

2. An assembly as in claim 1 wherein said flat electrically conductive cable further comprises first and second insulating layers formed respectively on said first and second sides of said cable adjacent said conductive layer and wherein said other end of said first conductive leg extends through said second insulating layer and said conductive layer.

3. An assembly as in claim 1 comprising:

a second backing member connected to and supporting said contact portion and having a second surface portion positioned upon a second section of said first side of said conductive layer and generally parallel to said second section;

a second conductive leg integrally connected at one end to said second backing member with its other end extending through said conductive layer of said cable;

said other end of said second conductive leg being crimped back upon itself in a curled configuration and penetrating through said conductive layer and then extending towards the junction of said second conductive leg and said second back member in a path adjacent and generally parallel with the second surface portion of said second backing member;

the first and second surface portions of said first and second backing members being separated from each other upon said first side of said conductive layer; and said first and second conductive legs being crimped in curled configuration in opposite directions.

4. An assembly as in claim 3 wherein said flat electrically conductive cable further comprises first and second insulating layers formed respectively on said first and second sides of said cable adjacent said conductive layer and wherein the said other ends of said first and second conductive legs extend through said second insulating layer and also said conductive layer.

* * * * *